US011771173B1

(12) United States Patent
Brons et al.

(10) Patent No.: US 11,771,173 B1
(45) Date of Patent: Oct. 3, 2023

(54) FOOTWEAR WITH FLUID DISTRIBUTION

(71) Applicant: THOLI INCORPORATED, Omaha, NE (US)

(72) Inventors: Krista Brons, Omaha, NE (US); Rachel Rebecca Baxter, Bellevue, NE (US)

(73) Assignee: THOLI INCORPORATED, Omaha, NE (US)

( * ) Notice: Subject to any disclaimer, the term of this patent is extended or adjusted under 35 U.S.C. 154(b) by 99 days.

(21) Appl. No.: 17/487,128

(22) Filed: Sep. 28, 2021

Related U.S. Application Data

(60) Provisional application No. 63/084,044, filed on Sep. 28, 2020.

(51) Int. Cl.

| | |
|---|---|
| ***A43B 7/00*** | (2006.01) |
| ***A43B 13/14*** | (2006.01) |
| ***A43B 13/12*** | (2006.01) |
| ***A43B 7/1455*** | (2022.01) |
| ***A43B 7/148*** | (2022.01) |
| ***A43B 7/1463*** | (2022.01) |
| *A43B 5/00* | (2022.01) |

(52) U.S. Cl.
CPC ..... *A43B 13/141* (2013.01); *A43B 7/148* (2013.01); *A43B 7/1455* (2013.01); *A43B 7/1463* (2022.01); *A43B 13/12* (2013.01); *A43B 5/00* (2013.01)

(58) Field of Classification Search
CPC ..... A43B 7/1463; A43B 7/148; A43B 7/149; A43B 13/12; A43B 7/1455; A43B 7/00
USPC ..... 36/44; 604/293; 424/402
See application file for complete search history.

(56) References Cited

U.S. PATENT DOCUMENTS 662,223 A * 11/1900 Crawford ..... A61N 1/0484 36/2.6
2,350,362 A * 6/1944 Margolin ..... A43B 21/26 36/3 R
2,713,215 A * 7/1955 Cosneck ..... A43B 7/28 36/44
4,793,078 A * 12/1988 Andrews ..... A43B 7/28 36/43
4,794,707 A * 1/1989 Franklin ..... A43B 7/148 36/31
4,887,367 A * 12/1989 Mackness ..... A43B 1/0018 36/35 B
5,077,915 A * 1/1992 Gross ..... A43B 13/12 36/31

(Continued)

*Primary Examiner* — Marie D Bays
(74) *Attorney, Agent, or Firm* — Daniel J. Honz; Advent, LLP

(57) ABSTRACT

Systems and methods for providing footwear that facilitate distribution of a fluid held by the footwear to a foot of a user are described. A footwear structure embodiment includes, but is not limited to, a sole including an upper layer, a bottom layer, and an intermediate layer coupled between the upper layer and the bottom layer, the sole defining a cavity through the upper layer and at least a portion of the intermediate layer; and a fluid distribution structure sized and dimensioned to fit at least partially within the cavity, the fluid distribution structure including a fluid retention portion configured to retain a fluid for release to a foot of a user when the user introduces the foot onto the sole and in contact with at least a portion of the fluid retention portion.

11 Claims, 9 Drawing Sheets

(56) References Cited

U.S. PATENT DOCUMENTS

| | | | | | |
|---|---|---|---|---|---|
| 5,329,705 | A * | 7/1994 | Grim | A43B 17/02 | 36/95 |
| 5,918,383 | A * | 7/1999 | Chee | A43B 13/206 | 36/35 B |
| 6,792,699 | B2 * | 9/2004 | Long | A43B 1/0081 | 36/95 |
| 6,792,701 | B1 * | 9/2004 | Ruffini | A43B 3/106 | 604/293 |
| 6,990,756 | B1 * | 1/2006 | Johnson | A43B 7/148 | 36/155 |
| 7,047,671 | B2 * | 5/2006 | Steed | A43B 13/24 | 36/43 |
| 7,237,346 | B2 * | 7/2007 | Lebo | A43B 7/1445 | 36/28 |
| 8,176,880 | B2 * | 5/2012 | Hurwitz | A01K 13/007 | 36/43 |
| 8,819,962 | B2 * | 9/2014 | Candella | A41B 11/007 | 36/43 |
| 9,737,112 | B2 * | 8/2017 | Kramer | A43B 7/24 | |
| 2004/0045195 | A1 * | 3/2004 | Long | A43B 7/147 | 36/88 |
| 2006/0277796 | A1 * | 12/2006 | Gallegos | A43B 17/02 | 36/44 |
| 2011/0308540 | A1 * | 12/2011 | Naftulin | A43B 7/144 | 132/74.5 |
| 2014/0088523 | A1 * | 3/2014 | Ottuso | A41B 11/02 | 604/293 |
| 2014/0310981 | A1 * | 10/2014 | Abshire | A43B 7/1425 | 36/28 |
| 2020/0029652 | A1 * | 1/2020 | Wert | A43B 17/18 | |
| 2020/0405012 | A1 * | 12/2020 | Hujing | B32B 23/08 | |

* cited by examiner

FOOTWEAR WITH FLUID DISTRIBUTION

CROSS-REFERENCE TO RELATED APPLICATIONS

The present application claims the benefit under 35 U.S.C. § 119(e) of U.S. Provisional Application Ser. No. 63/084,044, filed Sep. 28, 2020, and titled "FOOTWEAR WITH FLUID DISTRIBUTION." U.S. Provisional Application Ser. No. 63/084,044 is herein incorporated by reference in its entirety.

BACKGROUND

Footwear, such as shoes, boots, socks, and the like, provide comfort, stability, and protection for a user's foot during use. The soles of footwear can include multiple portions to interact with the ground (e.g., an outsole), to provide additional structure or stability to the sole (e.g., a midsole), and to interface with a user's foot (e.g., an insole), each with differing structures dependent on a function of the footwear. For example, athletic footwear can have sole structures that provide cushioning and stability, whereas dress or formal shoes can have sole structures that support lifts or heels.

SUMMARY

Systems and methods for providing footwear that facilitate distribution of a fluid held by the footwear to a foot of a user are described. A footwear structure embodiment includes, but is not limited to, a sole including an upper layer, a bottom layer, and an intermediate layer coupled between the upper layer and the bottom layer, the sole defining a cavity through the upper layer and at least a portion of the intermediate layer; and a fluid distribution structure sized and dimensioned to fit at least partially within the cavity, the fluid distribution structure including a fluid retention portion configured to retain a fluid for release to a foot of a user when the user introduces the foot onto the sole and in contact with at least a portion of the fluid retention portion.

In an aspect, a footwear structure embodiment includes, but is not limited to, a fabric sock structure defining an interior and including a sole having an upper layer within the interior; a first fastener coupled to the upper layer within the interior; and a fluid distribution structure sized and dimensioned to fit within the interior of the fabric sock structure, the fluid distribution structure including a fluid retention portion coupled to a substrate and including a second corresponding fastener coupled to the substrate to removably affix the fluid distribution structure to the sole, the fluid retention portion configured to retain a fluid for release to a foot of a user when the user introduces the foot onto the sole and in contact with at least a portion of the fluid retention portion.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DRAWINGS

The Detailed Description is described with reference to the accompanying figures. In the figures, the use of the same reference numbers in different instances in the description and the figures may indicate similar or identical items.

DETAILED DESCRIPTION

Overview

Figure 1:
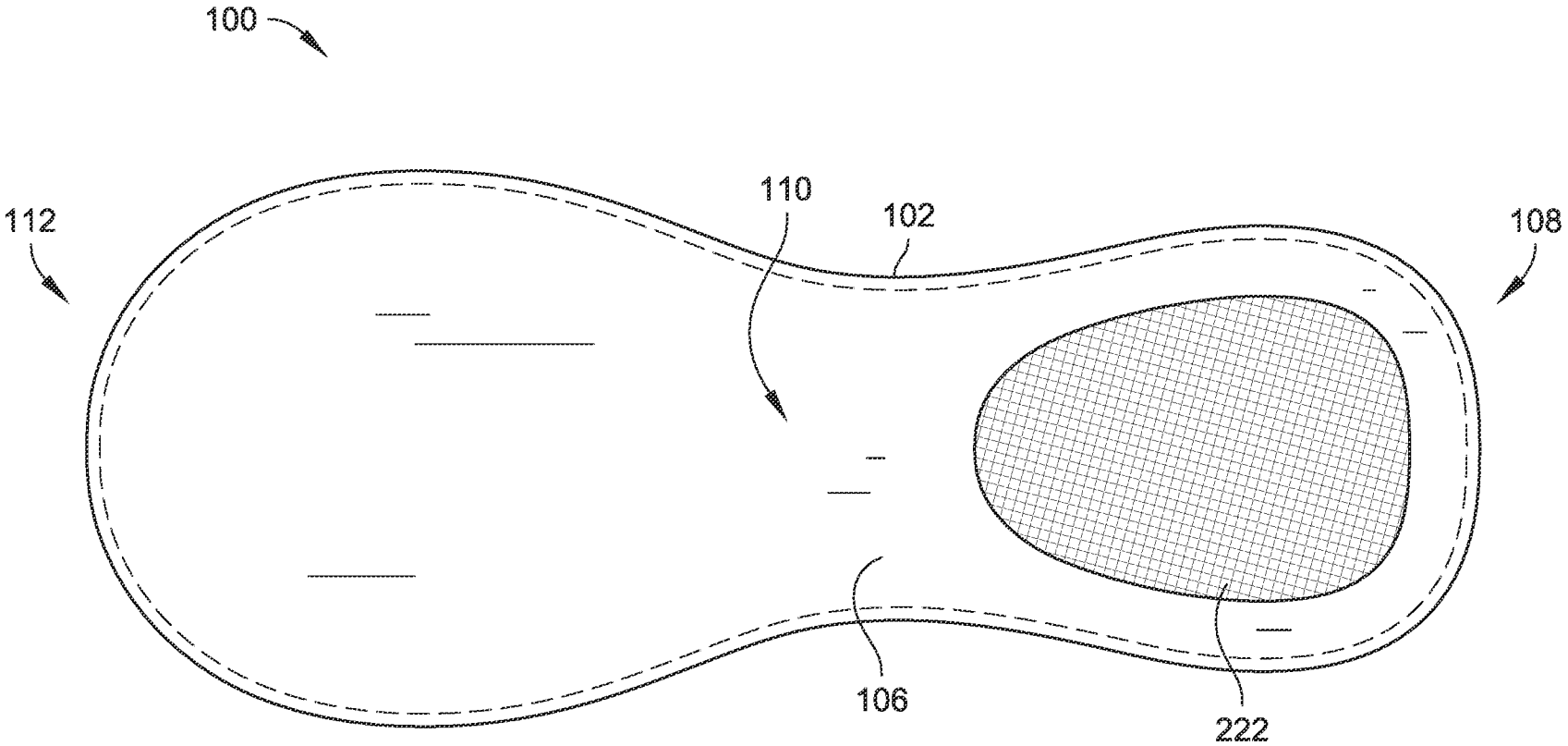
FIG. 1 is a top view of a footwear sole having a fluid distribution structure in accordance with example embodiments of the present disclosure.

Footwear incorporates many different types of sole structures to allow specific footwear to function within desired applications. For example, athletic footwear commonly has sole structures that differ from the design of soles for dress or formal footwear. Oftentimes, footwear includes sole structures that are designed to wick away fluids from an individual's foot to facilitate a dry interior in the region from the insole to the upper. For instance, the sole of the foot typically has a high concentration of sweat pores and thick layers of skin, where substantial moisture within the shoe interior can cause discomfort and odor. However, the foot also incorporates substantial amounts of blood vessels, particularly in the heel region, where traditional sole structures keep fluids away from these areas of the foot.

Accordingly, the present disclosure is directed, at least in part, to systems and methods for providing footwear that facilitate distribution of a fluid held by the footwear to a foot of a user. In an aspect, the footwear includes a sole having a fluid retention portion positioned on an upper surface of the sole. The fluid retention portion can define a reservoir or matrix configured to receive and hold a fluid (e.g., an oil, lotion, cream, emulsion, medicament, or the like, or combinations thereof) on the upper surface of the sole such that, when a user places their foot in contact with the sole, a portion of the user's foot can interact with the fluid held by the fluid retention portion. In implementations, the fluid retention portion is positioned at a rear portion of the insole such that that heel of the individual is configured to contact the fluid retention portion when the footwear is worn by the individual.

The footwear can include support structures to house or otherwise secure a fluid distribution structure to one or more portions of the sole of the footwear. In an embodiment, the sole includes an insole defining an aperture through which the fluid distribution structure can pass for introduction into an interior of the sole. For example, the midsole can define an aperture that extends partially into the midsole that aligns with the aperture in the insole. When the fluid distribution structure is received into the apertures of the insole and midsole, the midsole at least partially surrounds the fluid distribution structure to support the fluid distribution structure on the midsole. In implementations, the fluid distribution structure includes the fluid retention portion, which substantially aligns with the aperture in the insole, such as to provide a substantially continuous surface on which the heel of the user can rest.

The support structures to house or otherwise secure the fluid distribution structure can be formed, at least in part, by the outsole. For example, the outsole can form a support platform to be received in an aperture formed through the midsole, such that the support platform extends upwards from the outsole and into the aperture of the midsole to support a removeable and replaceable fluid distribution structure at least partially within the aperture. In implementations, the insole forms a corresponding aperture that aligns with the aperture through the midsole to permit introduction of the removeable and replaceable fluid distribution structure through the insole and into the midsole to contact an upper surface of the support platform. In implementations, the fluid distribution structure includes the fluid retention portion, which substantially aligns with the aperture in the insole, such as to provide a substantially continuous surface on which the heel of the user can rest.

Example Implementations

Referring to FIGS. 1-9, a footwear structure 100 is shown in accordance with example embodiments. The footwear structure 100 generally includes a sole 102 and a fluid retention portion 222 coupled with the sole 102. The footwear structure 100 can include, or can be included as a portion of, a shoe, a boot, a sock, or other footwear device to facilitate delivery of one or more fluids from the footwear structure 100 to one or more portions of a foot of the user. For example, as shown in FIG. 1, the fluid retention portion 222 is coupled to an upper surface 106 of the sole 102 adjacent a rear end 108 of the sole 102. The fluid retention portion 222 can be attached to the sole 102, such as through an adhesive, fastener, or combinations thereof. In implementations, the upper surface 106 is defined on an exterior surface of the insole of the footwear structure 100.

The fluid retention portion 222 retains a fluid on the footwear structure 100 for release to the foot of the user when the user introduces the foot onto or into the footwear structure to interact with the fluid retention portion 222. In implementations, the fluid retention portion 222 defines a reservoir or matrix configured to receive and hold a fluid on the upper surface 106 of the sole 102 such that, when a user places their foot in contact with the sole 102, a portion of the user's foot can interact with the fluid held by the fluid retention portion 222. For example, the fluid can include, but is not limited to, an oil, lotion, cream, emulsion, medicament, or the like, or combinations thereof, supported on or within the fluid retention portion 222. In implementations, the fluid includes a blend of oils provided for interaction with the foot of the individual, such as for direct contact absorption into the skin. During use, the foot of the user exerts a downward force against the fluid retention portion 222 which in turn can release at least a portion of the fluid against the foot in response to pressure changes in the material of the fluid retention portion 222. In implementations, the fluid is utilized to counteract discomfort, ailments, odor, or the like experienced by the user through contact of the fluid with the heel and/or another portion of the foot.

The fluid retention portion 222 can be constructed from a fibrous material configured to hold the fluid on the fluid retention portion 222 when in a neutral or uncompressed state (e.g., when not interacting with the user's foot) and to release at least a portion of the fluid when in a compressed state (e.g., when interacting with the user's foot). For example, in implementations, the fluid retention portion 222 includes a wool material, such as a natural wool, synthetic wool, or combinations thereof. In implementations, the fluid retention portion 222 is constructed of a material that is distinct from the material of the sole 102 surrounding or supporting the fluid retention portion 222. For example, the sole 102 can include a material, including but not limited to, bamboo that supports a wool-based fluid retention portion 222. Alternatively or additionally, the fluid retention portion 222 includes a coloration or visual pattern distinct from the other portions of the sole 102. In implementations, at least a portion of the sole 102 is constructed from a bamboo material that is scented or otherwise fluid treated, such as by being treated with an oil, lotion, medicament, fluid, or other material.

The fluid retention portion 222 is shown in FIG. 1 as being positioned adjacent the rear end 108 of the sole 102 to interact with a heel of the foot of the user, however the footwear structure 100 is not limited to such fluid retention portion 222 positioning. For instance, the footwear structure 100 can include the fluid retention portion 222 positioned at one or more additional or alternative positions on the footwear structure 100, including, but not limited to, a central position 110 of the sole 102 (e.g., to interact with an arch of the foot), adjacent a front end 112 of the sole 102 (e.g., to interact with toes of the foot, the ball of the foot, or combinations thereof), or other position on the sole 102.

Figure 2:
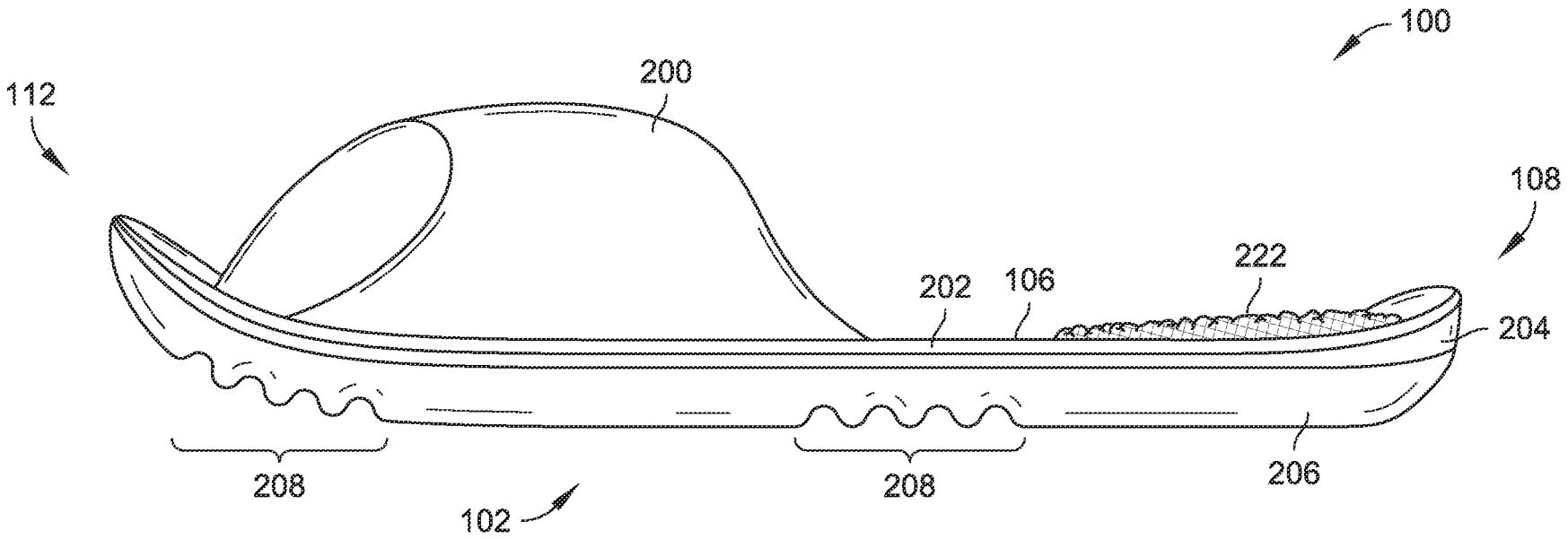
FIG. 2 is a side view of a footwear structure having an upper coupled to the footwear sole of FIG. 1.
Figure 3:
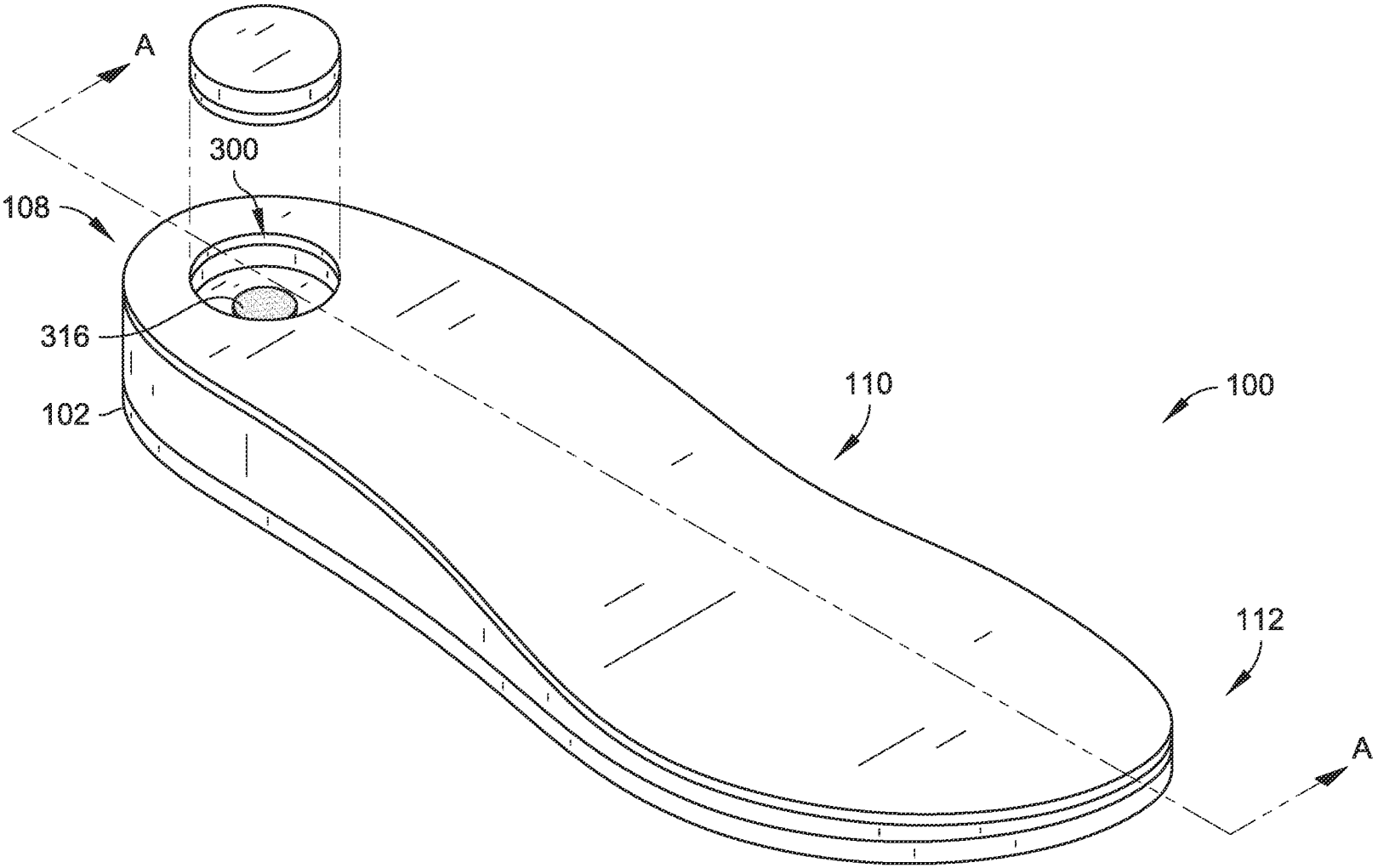
FIG. 3 is an isometric view of a footwear structure having an aperture configured to support a fluid distribution structure in accordance with example embodiments of the present disclosure.
Figure 4:
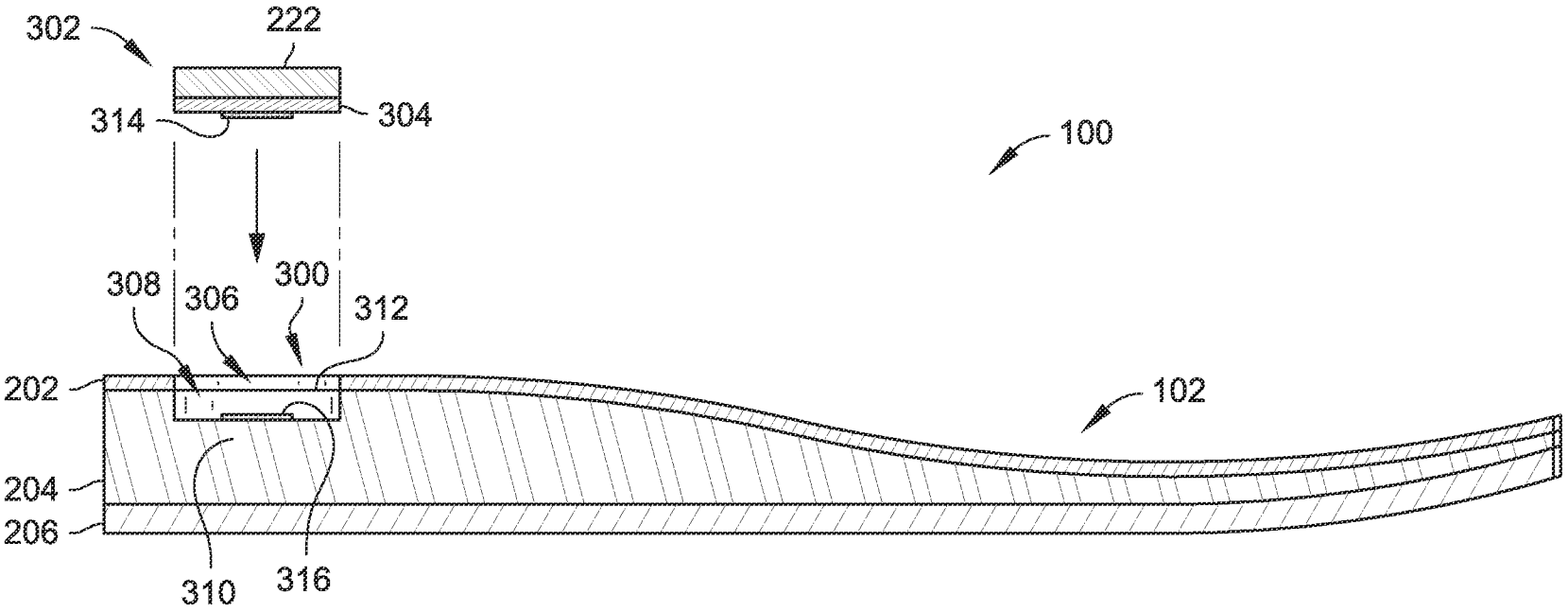
FIG. 4 is a cross sectional view of the footwear structure of FIG. 3, taken along A-A, showing a removeable and replaceable fluid distribution structure to be received in the aperture formed partially through the midsole.
Figure 5:
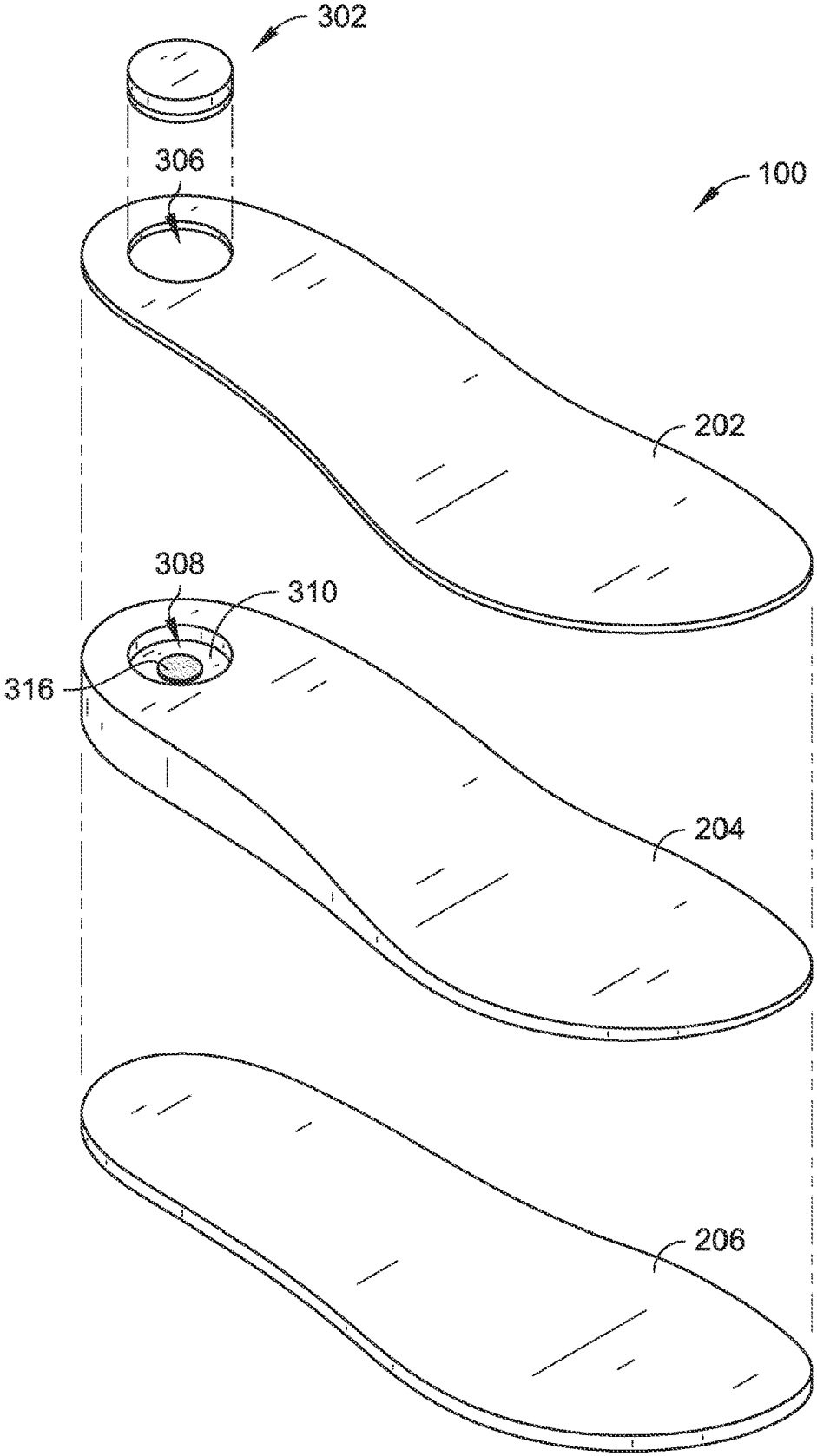
FIG. 5 is an exploded view of the footwear structure of FIG. 4, showing a removeable and replaceable fluid distribution structure to be received in the aperture.

Referring to FIG. 2, the footwear structure 100 is shown with the sole 102 being coupled with an upper 200 configured to form a sandal. The footwear structure 100 provides support for the user's foot and body, while also absorbing/dissipating force while moving and standing to support alignment of the foot and leg joints with the spine. The sole 102 can be constructed from multiple layers of material coupled together. For example, the sole 102 is shown in FIG. 2 as including an upper layer 202, an intermediate layer 204, and a bottom layer 206. The upper layer 202 can provide an insole for the footwear structure 100 and can include the upper surface 106. In implementations, the upper layer 202 is formed at least partially from a bamboo material that is scented or otherwise fluid-treated, such as by being treated with an oil, lotion, medicament, fluid, or other material. For example, the upper layer 202 can be formed from woven bamboo strips that have been fluid-treated with an oil, lotion, medicament, fluid, or other material.

The intermediate layer 204 can provide a midsole for the footwear structure 100 and is coupled between the upper layer 202 and the bottom layer 206. For example, the intermediate layer 204 can be affixed between the upper layer 202 and the bottom layer 206 via an adhesive material, a fastener, or combinations thereof. The intermediate layer 204 can include a material that conforms to the contours of the user's foot during usage. For example, in implementations, at least a portion of the intermediate layer 204 includes a cork material. In implementations, the intermediate layer 204 is constructed from a material that does not substantially expand upon exposure to liquid, such as by having less than a 10% change in volume upon exposure to the liquid held by the fluid retention portion 222. Such material property can facilitate maintaining the structure of the sole 102 in instances where the fluid interacts with the intermediate layer 204 (e.g., at the rear end 108 of the sole 102), such as by preventing absorption of the fluid, expansion of the material of the intermediate layer 204, or the like.

The bottom layer 206 can include a structural material suitable for prolonged contact with the ground surface. For example, the bottom layer 206 can include a rubber or synthetic rubber material, such as a material formed at least partially from a recycled tire material. The bottom layer 206 can define one or more ridges, grooves, or other textured surface treatment (shown in FIG. 2 as 208) to facilitate traction during ambulation.

The upper 200 is shown in FIG. 2 as providing an open-toed or sandal configuration for the footwear structure 100, however the present disclosure is not limited to such configuration. For example, the upper 200 can include a structure to provide a closed-toed configuration, an enclosed-heel configuration, a boot configuration, or other upper configuration as desired for style, comfort, and wearability options.

The footwear structure 100 can include support structures to house or otherwise secure a fluid distribution structure to one or more portions of the sole 102. For example, referring to FIGS. 3-7, the footwear structure 100 is shown with a cavity 300 in the sole 102 to receive a fluid distribution structure 302 to support the fluid retention portion 222 at least partially within the sole 102 for access to the user's foot. The fluid distribution structure 302 is shown including the fluid retention portion 222 secured to a substrate 304, which can be formed from a variety of materials including, but not limited to, rubber, felt, plastic, wool, or the like, or combinations thereof. Alternatively, the fluid distribution structure 302 can include the fluid retention portion 222 for direct introduction into the cavity 300 without an intervening substrate 304. In implementations, all or a portion of the fluid retention portion 222 can be covered with a mesh material, such as to assist with maintaining the structural integrity or shape of the material of the fluid retention portion 222.

The cavity 300 can be formed through a variety of configurations of the upper layer 202, the intermediate layer 204, and the bottom layer 206. For example, referring to FIGS. 4 and 5, the cavity 300 is shown being formed from aligned apertures in the upper layer 202 and the intermediate layer 204. The upper layer 202 is shown defining an insole aperture 306 through which the fluid distribution structure 302 can pass for introduction into an interior of the sole 102. The intermediate layer 204 includes a midsole aperture 308 that is vertically aligned with the insole aperture 306 to form the cavity 300. The midsole aperture 308 extends partially into the intermediate layer 204 such that a portion 310 of the intermediate layer 204 separates the cavity 300 from the bottom layer 206. When the fluid distribution structure 302 is received into the cavity 300, the intermediate layer 204 at least partially surrounds the fluid distribution structure 302 to support the fluid distribution structure 204 on the upper surface of the portion 310 of the intermediate layer 204.

In implementations, the fluid distribution structure 302 positions the fluid retention portion 222 within the cavity 300 to substantially align the fluid retention portion 222 with the upper layer 202 to provide a substantially continuous surface on which the foot of the user can rest during use of the footwear structure 100. For example, in implementations, when the fluid distribution structure 302 is inserted into the cavity 300, the substrate 304 is positioned on the portion 310 and remains beneath a boundary 312 between the intermediate layer 204 and the upper layer 202. The fluid retention portion 222 can have a thickness such that the fluid retention portion 222 extends from the substrate 304 to cross the boundary 312 between the between the intermediate layer 204 and the upper layer 202 to substantially align the fluid retention portion 222 with the upper layer 202. Alternatively or additionally, portions of the fluid retention portion 222 can extend outwardly from the substrate 304 beyond the upper layer 202, such that, upon compression of the fluid retention portion 222 by the user, the fluid retention portion 222 aligns with the upper layer 202 to provide a substantially continuous surface on which the foot of the user can rest during use of the footwear structure 100.

Figure 6:
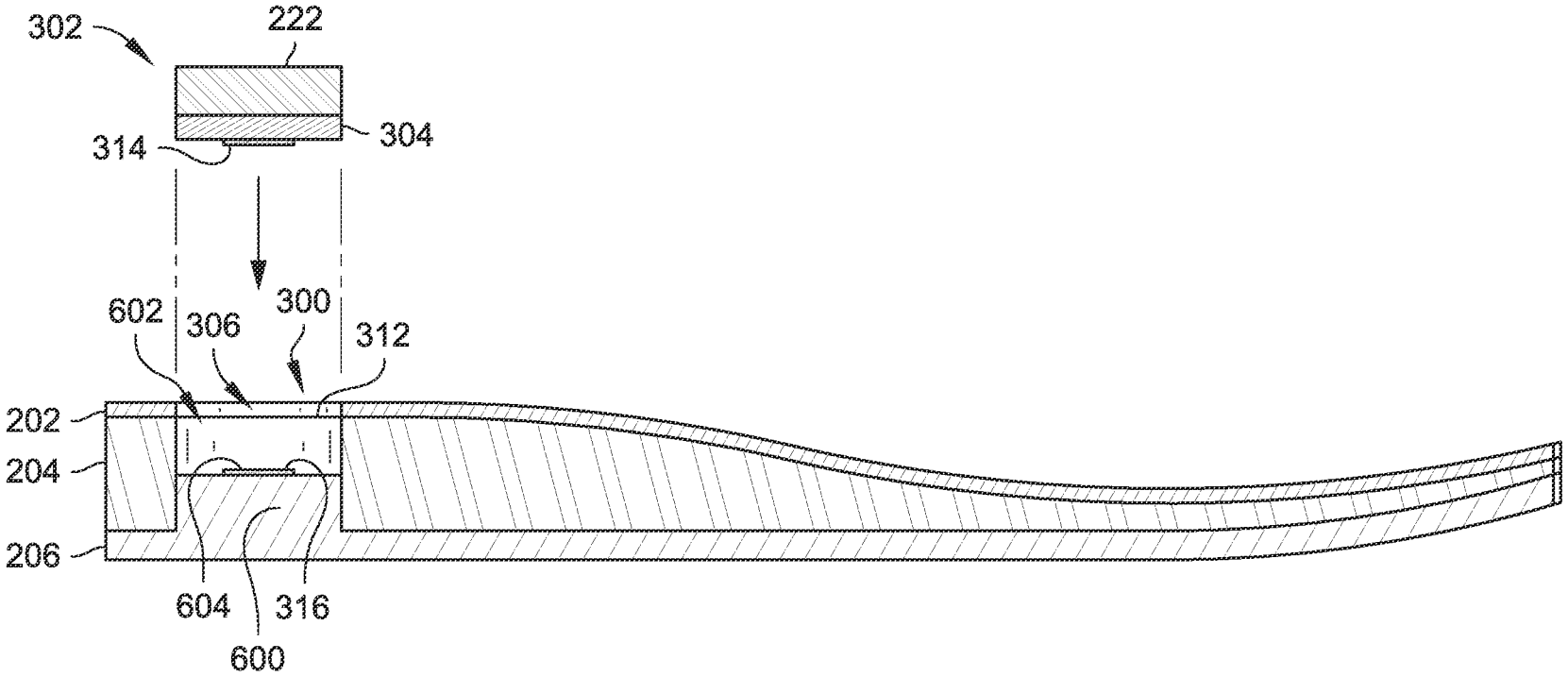
FIG. 6 is a cross sectional view of the footwear structure of FIG. 3, taken along A-A, showing a support platform formed by the outsole to be received in the aperture formed through the midsole to support the removeable and replaceable fluid distribution structure in the aperture.
Figure 7:
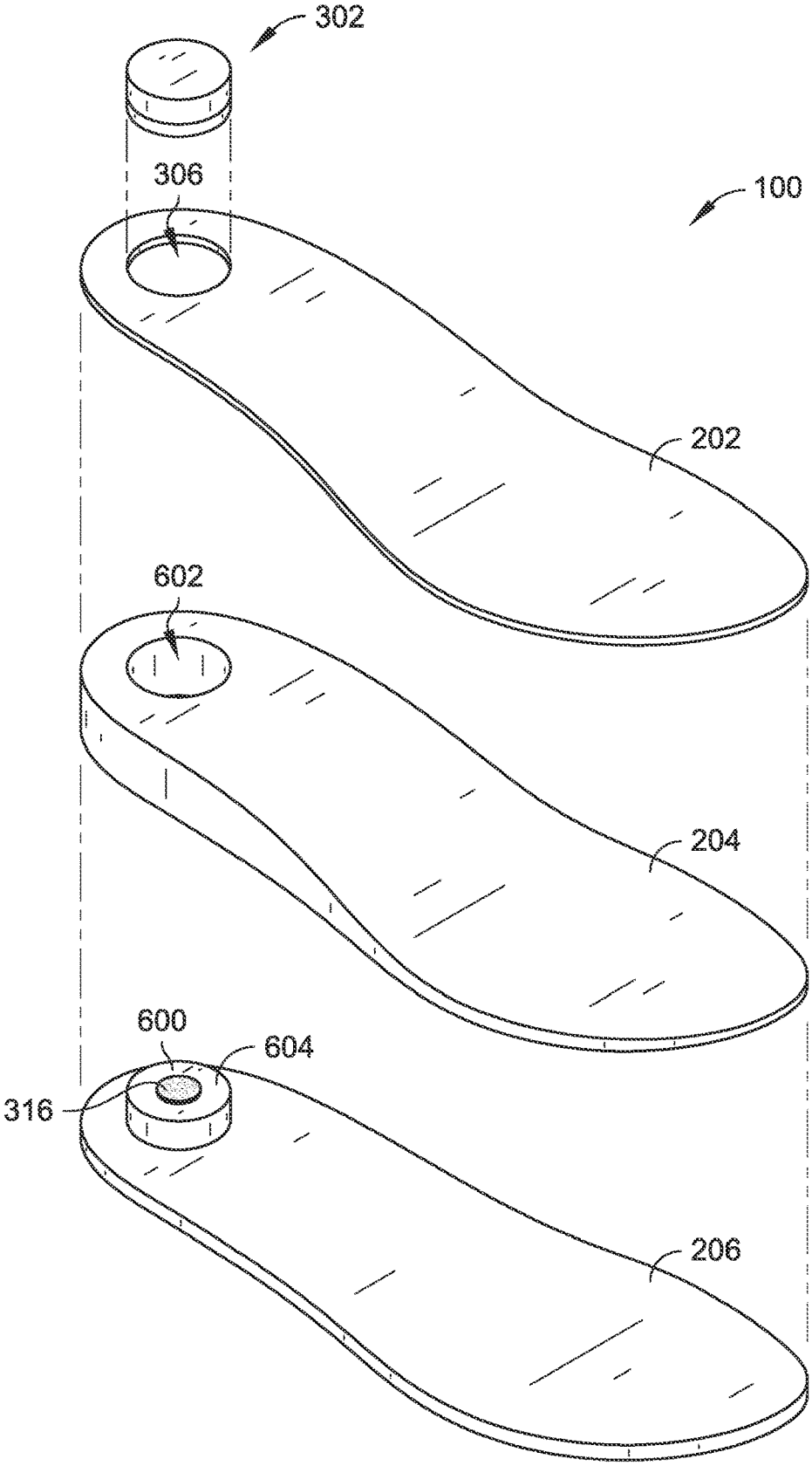
FIG. 7 is an exploded view of the footwear structure of FIG. 6, showing the support platform formed by the outsole and the removeable and replaceable fluid distribution structure to be received in the aperture supported by the support platform.

Referring to FIGS. 6 and 7, the cavity 300 is shown being formed from portions of each of the upper layer 202, the intermediate layer 204, and the bottom layer 206. The bottom layer 206 includes a support platform 600 extending upwards from a surface of the bottom layer 206 to align with a midsole aperture 602 that extends through the intermediate layer 204. The support platform 600 extends upwards from the bottom layer 206 and into the midsole aperture 602 to support the removeable and replaceable fluid distribution structure 302 at least partially within the midsole aperture 602. In implementations, the insole aperture 306 aligns with the midsole aperture 602 to permit introduction of the removeable and replaceable fluid distribution structure 302 through the upper layer 202 and into the intermediate layer 204 to contact an upper surface 604 of the support platform 600.

In implementations, the fluid distribution structure 302 positions the fluid retention portion 222 within the cavity 300 to substantially align the fluid retention portion 222 with the upper layer 202 to provide a substantially continuous surface on which the foot of the user can rest during use of the footwear structure 100. For example, in implementations, when the fluid distribution structure 302 is inserted into the cavity 300, the substrate 304 is positioned on the support platform 600 beneath the boundary 312 between the intermediate layer 204 and the upper layer 202. The fluid retention portion 222 can have a thickness such that the fluid retention portion 222 extends from the substrate 304 to cross the boundary 312 between the between the intermediate layer 204 and the upper layer 202 to substantially align the fluid retention portion 222 with the upper layer 202. Alternatively or additionally, portions of the fluid retention portion 222 can extend outwardly from the substrate 304 beyond the upper layer 202, such that, upon compression of the fluid retention portion 222 by the user, the fluid retention portion 222 aligns with the upper layer 202 to provide a substantially continuous surface on which the foot of the user can rest during use of the footwear structure 100.

The removeable and replaceable fluid distribution structure 302 can include structures to temporarily affix the fluid distribution structure 302 within the cavity 300, such as to prevent the fluid retention portion 222, the substrate 304, or combinations thereof from leaving the cavity 300 during use of the footwear structure 100. In implementations, the fluid retention portion 222, the substrate 304, or combinations thereof includes a fastener to temporarily affix the fluid distribution structure 302 to one or more surfaces of the cavity 300. For example, the substrate 304 is shown having a fastener 314 coupled to a bottom surface of the substrate 304 to interface with a corresponding fastener 316 in the cavity 300 (e.g., positioned on the portion 310 of the intermediate layer 204 or on the upper surface 604 of the support platform 600). The fasteners 314, 316 can include, but are not limited to, adhesives, hook and loop structures, snap structures, clip structures, or the like, where the footwear structure 100 can include the fasteners 314, 316 individually or in combination.

The cavity 300 is shown in FIGS. 3-7 and FIG. 9 as being positioned adjacent the rear end 108 of the sole 102 to permit interaction between the fluid retention portion 222 (and liquid held thereon) with a heel of the foot of the user, where some of the body's largest pores are located for efficient infusion of the liquid from the fluid retention portion 222 into the user's skin, however the footwear structure 100 is not limited to such cavity 300 positioning. For instance, the footwear structure 100 can include the cavity 300 positioned at one or more additional or alternative positions on the footwear structure 100, including, but not limited to, the central position 110 of the sole 102 (e.g., to interact with an arch of the foot), adjacent the front end 112 of the sole 102 (e.g., to interact with toes of the foot, the ball of the foot, or combinations thereof), or other position on the sole 102.

During use of the footwear structure 100 with the cavity 300, the user can introduce the removeable and replaceable fluid distribution structure 302 into the cavity 300 to be supported by the portion 310 of the intermediate layer 204, the support platform 600, or combinations thereof. The fluid distribution structure 302 includes the fluid retention portion 222 and fluid held by the fluid retention portion 222, which can be introduced to the fluid retention portion 222 prior to introduction to the cavity 300, subsequent to introduction to the cavity 300, or the like. During ambulation or when otherwise pushing the foot against the footwear structure 100, the foot of the user exerts a downward force against the fluid retention portion 222 to cause deformation of at least a portion of the fluid retention portion 222. As the fluid retention portion 222 deforms, at least a portion of the fluid is released against the foot in response to pressure changes in the material of the fluid retention portion 222. The fluid distribution structure 302 can be removed from the cavity 300 and replaced with a different fluid distribution structure 302, such as when use of the footwear structure 100 results in wear or fouling of the fluid retention portion 222. Additional fluid can be introduced to a multi-use fluid retention portion 222, or can be introduced to the footwear structure 100 through a different fluid distribution structure 302.

Figure 8:
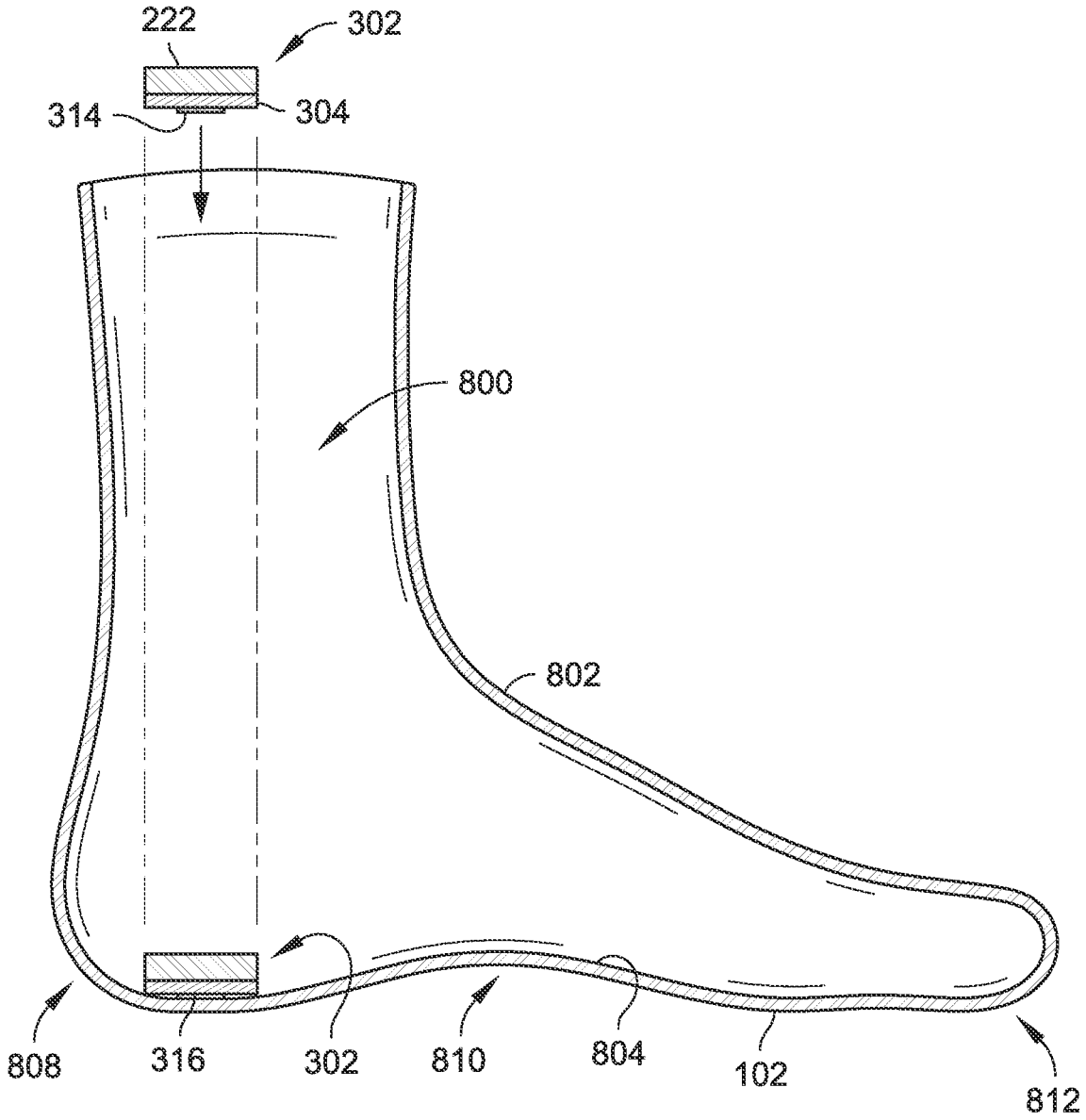
FIG. 8 is a cross sectional view of a footwear structure having a sock structure configured to receive a removeable and replaceable fluid distribution structure within an interior of the sock structure in accordance with example embodiments of the present disclosure.

Referring to FIG. 8, the footwear structure 100 is shown in a sock embodiment with the removeable and replaceable fluid distribution structure 302 configured to be inserted into an interior 800 of a sock structure 802 formed from a stretchable and deformable textile material. For instance, the sock structure 802 can include the fastener 316 on an upper surface 804 of the sole 102 or otherwise embedded into the material of the sock. As shown, the fastener 316 is coupled to the upper surface 804 of the sole 102 near a heel portion 808 of the sock to permit interaction between the fluid retention portion 222 (and liquid held thereon) with a heel of the foot of the user where some of the body's largest pores are located for efficient infusion of the liquid from the fluid retention portion 222 into the user's skin, however the footwear structure 100 is not limited to such positioning of the fluid retention portion 222. For instance, the footwear structure 100 can include the fastener 316 positioned at one or more additional or alternative positions on the footwear structure 100, including, but not limited to, a central position 810 of the sole 102 (e.g., to interact with an arch of the foot), adjacent a front end 812 of the sole 102 (e.g., to interact with toes of the foot, the ball of the foot, or combinations thereof), or other position on the sole 102 within the interior 800 of the sock structure 802.

The sock structure 802 can be formed from a material that differs that the material forming the fluid retention portion 222. For example, in implementations, at least a portion of the sock structure 802 is formed from a bamboo fabric and the fluid retention portion 222 is formed from wool. For example, the sock structure 802 can be formed from a blend of bamboo fabric and one or more additional synthetic or natural thread products (e.g., nylon, elastic, etc.). Alternatively or additionally, the sock structure 802 can be formed from a first wool material and the fluid retention portion 222 can be formed from a second wool material. In implementations, the sock structure 802 is scented or otherwise fluid treated, such as by being treated with an oil, lotion, medicament, fluid, or other material.

During use of the footwear structure 100 having the sock structure 802, the user can introduce the removeable and replaceable fluid distribution structure 302 into the interior 800 to be supported by the upper surface 804 of the sole 102 (e.g., coupling fastener 314 with fastener 316). The fluid distribution structure 302 includes the fluid retention portion 222 and fluid held by the fluid retention portion 222, which can be introduced to the fluid retention portion 222 prior to introduction to the interior 800, subsequent to introduction to the interior 800, or the like. During ambulation or when otherwise pushing the foot against the footwear structure 100, the foot of the user exerts a downward force against the fluid retention portion 222 to cause deformation of at least a portion of the fluid retention portion 222. As the fluid retention portion 222 deforms, at least a portion of the fluid is released against the foot in response to pressure changes in the material of the fluid retention portion 222. The fluid distribution structure 302 can be removed from the interior 800 and replaced with a different fluid distribution structure 302, such as when use of the footwear structure 100 results in wear or fouling of the fluid retention portion 222. Additional fluid can be introduced to a multi-use fluid retention portion 222, or can be introduced to the footwear structure 100 through a different fluid distribution structure 302.

Figure 9:
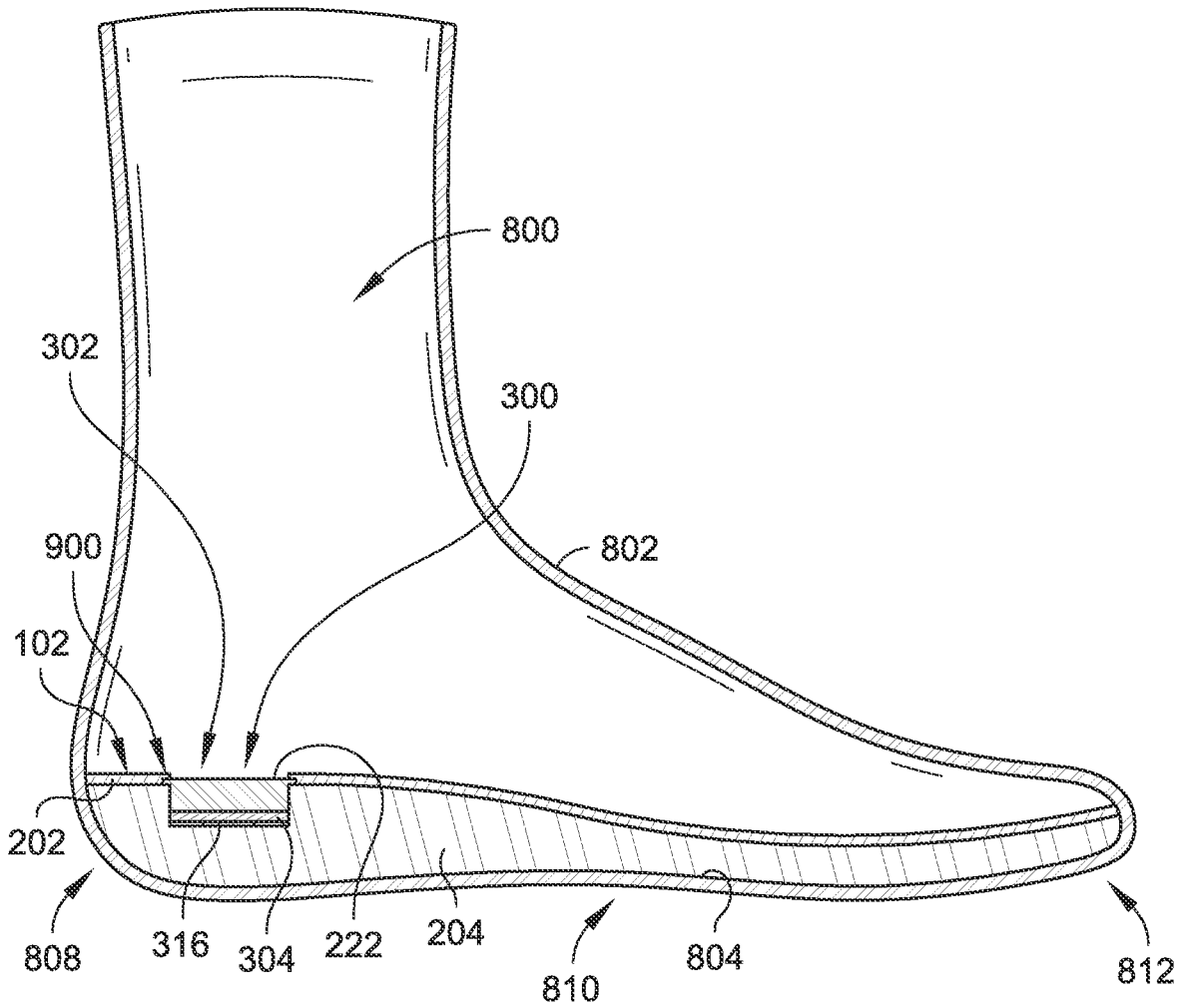
FIG. 9 is a cross sectional view of a footwear structure having a sock structure configured to receive a removeable and replaceable fluid distribution structure via an insert within an interior of the sock structure in accordance with example embodiments of the present disclosure.

Referring to FIG. 9, the footwear structure 100 is shown in a sock embodiment with the removeable and replaceable fluid distribution structure 302 configured to be inserted into an interior 800 of a sock structure 802 via the sole 102 forming an insert placed into the interior 800 (e.g., extending from the heel portion 808 to the front end 812). For instance, the sole insert can be formed from the intermediate layer 204 and the upper layer 202 to receive the fluid distribution structure 302 into the cavity 300 formed by the sole 102. In implementations, the bottom layer 206 can be included in the insert, however the bottom layer 206 is excluded from the embodiment shown in FIG. 9. The intermediate layer 204 and the upper layer 202 can define the cavity 300 to receive the fluid distribution structure 302 within the cavity 300 to hold the fluid retention portion 222 in place within the sock structure 802. For example, the upper layer 202 is shown with an insole aperture (e.g., as described with reference to FIGS. 3-5) through which the fluid distribution structure 302 can pass for introduction into an interior of the sole 102. The intermediate layer 204 includes a midsole aperture that is vertically aligned with the insole aperture to form the cavity 300. The midsole aperture extends partially into the intermediate layer 204 such that a portion of the intermediate layer 204 separates the cavity 300 from the upper surface 804 of the sock structure 802 (e.g., as described with reference to FIGS. 3-5). When the fluid distribution structure 302 is received into the cavity 300, the intermediate layer 204 at least partially surrounds the fluid distribution structure 302 to support the fluid distribution structure 302 on the intermediate layer 204. While the sole insert is described being configured to be introduced to the sock structure 802, it will be appreciated that the sole insert can be used with a variety of footwear structures including, but not limited to, sandals, shoes, boots, and the like.

In implementations, the sole insert includes an overlap 900 to secure a portion of the fluid retention portion 222 between the intermediate layer 204 and the upper layer 202. For example, the sole insert shown in FIG. 9 provides the overlap 900 adjacent the cavity 300 to provide a portion of the fluid retention portion 222 between intermediate layer 204 and the upper layer 202 to hold the fluid distribution structure 302 within the cavity 300. Such overlap 900 can provide a secure fit of the fluid distribution structure 302 on the sole insert, which can maintain positioning of the fluid distribution structure 302 during use and ambulation by the user. The sole insert can additionally or alternatively include structures to temporarily affix the fluid distribution structure 302 within the cavity 300, such as by including the fastener 314 coupled to a bottom surface of the substrate 304 to interface with a corresponding fastener 316 in the cavity 300 (e.g., positioned on the intermediate layer 204. In implementations, the fluid retention portion 222 extends upward from the cavity 300 and extends beyond the upper layer 202 such that, when compressed by the user during use of the footwear structure 100, a top portion of the fluid retention portion 222 is at least partially above the upper layer 202, is even with the upper layer 202, or is substantially adjacent the upper layer 202 to provide a substantially continuous surface to support the user's foot.

CONCLUSION

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

The invention claimed is:

1. A footwear structure for distribution of a fluid to a foot of a user, comprising:

a sole including an upper layer, a bottom layer, and an intermediate layer coupled between the upper layer and the bottom layer, the sole defining a cavity through the upper layer and at least a portion of the intermediate layer; and a fluid distribution structure sized and dimensioned to fit at least partially within the cavity, the fluid distribution structure including a fluid retention portion configured to retain a fluid for release to a foot of a user when the user introduces the foot onto the sole and in contact with at least a portion of the fluid retention portion, wherein the bottom layer defines a support platform extending upwards from a surface of the bottom layer, the support platform configured to support the fluid distribution structure within the cavity, the support platform including a fastener coupled to an upper surface of the support platform to removably affix the fluid distribution structure within the cavity.

2. The footwear structure of claim 1, wherein the cavity is formed from a first aperture defined through the upper layer and a second aperture partially through the intermediate layer, the first aperture aligned with the second aperture.

3. The footwear structure of claim 1, wherein the cavity is formed from a first aperture defined through the upper layer, a second aperture defined through the intermediate layer, and the upper surface of the support platform.

4. The footwear structure of claim 3, wherein the first aperture is aligned with the second aperture, and wherein the support platform is aligned with the second aperture.

5. The footwear structure of claim 1, wherein the fluid distribution structure includes the fluid retention portion coupled to a substrate.

6. The footwear structure of claim 5, wherein at least a portion of the substrate is configured to rest on the support platform within the cavity.

7. The footwear structure of claim 6, wherein the substrate is positioned beneath a boundary between the upper layer and the intermediate layer when the fluid distribution structure is positioned on the support platform.

8. The footwear structure of claim 7, wherein the fluid retention portion extends from the substrate and crosses the boundary between the upper layer and the intermediate layer when the fluid distribution structure is positioned on the support platform.

9. The footwear structure of claim 7, wherein a portion of the fluid retention portion extends beyond the upper layer when the fluid distribution structure is positioned on the support platform.

10. The footwear structure of claim 7, wherein the fluid retention portion and the upper layer form a substantially continuous surface to interface with the foot of the user.

11. The footwear structure of claim 5, wherein the fluid distribution structure includes a second corresponding fastener coupled to the substrate to removably couple the fluid distribution structure to the support platform.

* * * * *